United States Patent [19]

Gardner

[11] Patent Number: 4,466,313

[45] Date of Patent: Aug. 21, 1984

[54] FINGER TIP OPERATED TAB TOP BEVERAGE CONTAINER OPENER

[76] Inventor: Timothy P. Gardner, 4060 S. Quarterline Rd., Muskegon, Mich. 49444

[21] Appl. No.: 490,844

[22] Filed: May 2, 1983

[51] Int. Cl.[3] ..... B67B 7/40

[52] U.S. Cl. ..... 81/3.46 R; 294/25; D8/40

[58] Field of Search ..... 81/3.46 R, 3.34, 3.4; 30/298; 294/25; D8/33, 40

[56] References Cited

U.S. PATENT DOCUMENTS

| | | | |
|---|---|---|---|
| 4,253,352 | 3/1981 | O'Neal | 81/3.46 R |
| 4,257,287 | 3/1981 | Dawson | 81/3.34 |
| 4,309,921 | 5/1980 | Miller | 81/3.46 R |
| 4,373,223 | 2/1983 | Miller | 81/3.46 R |
| 4,391,167 | 7/1983 | Bergmeister | 81/3.46 R |

FOREIGN PATENT DOCUMENTS

| | | | |
|---|---|---|---|
| 549802 | 10/1956 | Italy | 294/25 |

*Primary Examiner*—Roscoe V. Parker

*Attorney, Agent, or Firm*—John A. Waters

[57] ABSTRACT

A finger tip operated tab top beverage container opener comprises a tubular body having a finger tip opening in one end and a tab top opener at the other end. The finger tip opening is rounded to accommodate a finger tip, while the tab top opener is a flattened portion of the tube in which the tab of a tab top container is received. The flattened portion forms the bottom of the finger tip opening and is offset to the side of the finger tip opening such that an elongated fingernail on the user can extend into the flattened portion of the opener. A tab top can be opened by inserting the flattened portion over the tab and prying upwardly with a finger tip inserted in the finger tip opening.

5 Claims, 3 Drawing Figures

FINGER TIP OPERATED TAB TOP BEVERAGE CONTAINER OPENER

BACKGROUND OF THE INVENTION

1. Field of the Invention

This invention relates to a tab top beverage container opener and more particularly to one that is operated by a finger tip.

2. Description of the Prior Art

Most twelve ounce carbonated beverage cans are opened by tab top openers incorporated into the top of an aluminum can. Such openers comprise a frangible portion of the top that can be broken away by manipulation of a protruding tab attached to the frangible portion. In a non-removable tab top container, the container is opened by prying the tab upwardly until the frangible portion is partially broken off and hinged downwardly into the interior of the can. With such containers, it is sometimes difficult to pry the tab upwardly from the top of the can in order to open the container. This is particularly difficult for women and sometimes causes broken fingernails.

Other tools have been developed to facilitate the opening of such cans. Generally, however, such devices are hand-held units and have to be picked up and set down each time a can is opened. This is undesirable, particularly where the device is used frequently.

The present invention provides a simple yet effective tab top opener that can be worn easily on a finger tip for repeated or continuous use of the opener.

SUMMARY OF THE INVENTION

In accordance with the present invention, a finger tip operated tab top beverage container opener comprises a body having a finger tip opening in one end and a tab top opener at the other end, the finger tip opening being rounded to accommodate a finger tip, the tab top opener comprising a tab top prying member extending outwardly from the portion of the body housing the finger tip opening. The prying member has at least one flat side that fits under the tab top of a tab top beverage container such that a tab top can be opened by upward pressure exerted on the prying member by a finger tip inserted in the finger tip opening.

The tab top opener of the present invention preferably comprises a tubular member having openings at both ends, with one end being rounded and serving as a finger tip opening and the other end having at least one flat side and serving as the prying member. The flat side is thin enough to fit under the tab of the tab top beverage container.

Desirably, a tab top opener comprises a flattened portion of the tubular member with opposing, spaced sides that closely fit over the tab. The outer edges of both sides are tapered, so either side can fit under the tab. The flattened portion serves as the bottom of the finger tip portion of the opener. Desirably, the flattened portion is offset to the side of the finger tip portion, such that an elongated fingernail on the finger tip of the user can extend into the flattened portion of the opener.

These and other advantages and features of the present invention are described below and shown in the attached drawings.

DETAILED DESCRIPTION OF PREFERRED EMBODIMENT

Figure 1:
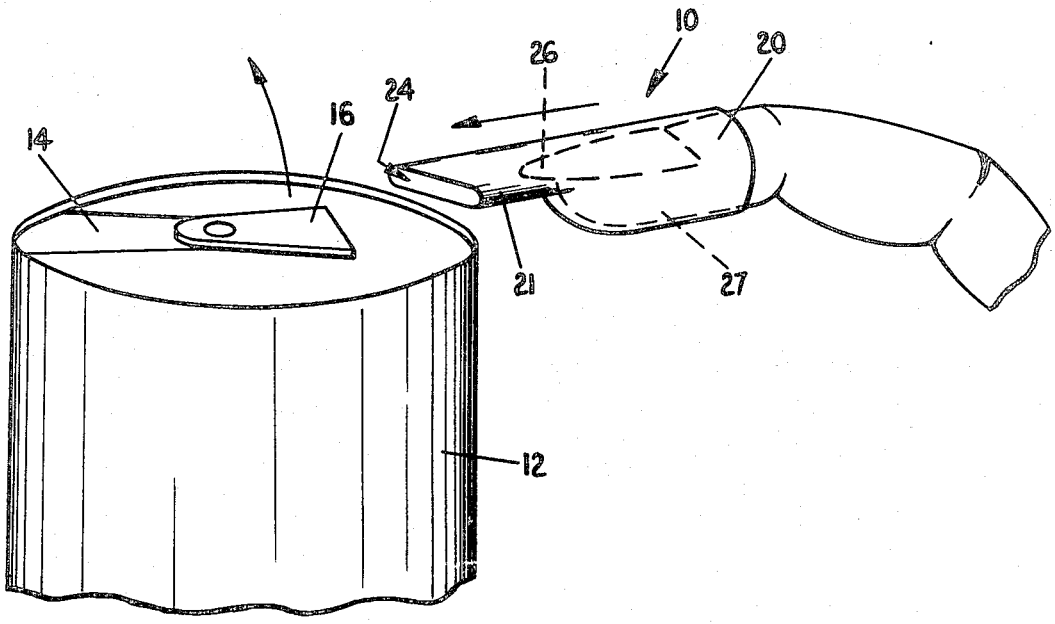
FIG. 1 is a perspective view showing the present invention as it is used in opening a tab top beverage container.
Figure 2:
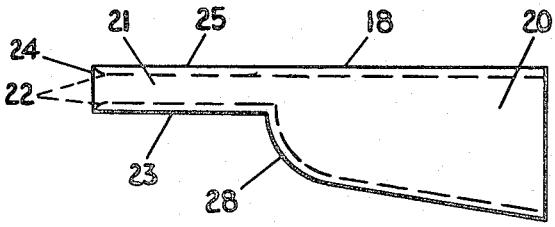
FIG. 2 is a side elevational view of the tab top opener of the present invention.
Figure 3:
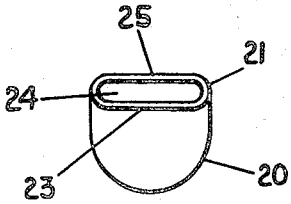
FIG. 3 is an end view taken along lines 3—3 of FIG. 2.

Referring to the drawings, a finger tip operated tab top beverage container opener 10 is shown in the process of opening a tab top beverage container 12 in FIG. 1. Container 12 comprises a frangible section 14 formed in the top of the can, which is aluminum. A tab 16 is attached at one side of the frangible portion. The tab lays almost flat against the top of the container when the container is closed. The container is opened by prying the tab upwardly. This exerts a downward pressure on the frangible portion and causes it to break away from the top and pivot or hinge downwardly into the interior of the can. This type of tab top container is called a non-removable tab top container and is the specific type of container that the present invention is designed to open in the exemplary embodiment.

The tab top opener of the present invention comprises a tubular body 18 having a finger tip portion 20 at one end and a tab top opener portion 21 at the other end. The finger tip portion 20 comprises a rounded opening of a size sufficient to accommodate a finger tip. The tab top opener portion 21 is a flattened portion of the tube having an interior opening 24 of sufficient size to fit over the tab of a tab top beverage container. Desirably, the flattened portion is at least the length of the tab of a tab top container and preferably is about 1¼ inches long. The opening comprises parallel spaced flat sides 23 and 25 that are about 3/16 inches apart. Desirably, the interior opening in the flattened end is about 13/16 inches wide. The diameter of the interior opening in the finger tip portion of the opener is about ⅞ inches. The overall length of the device desirably is about 3 inches.

As shown in the drawings, the flattened portion of the device is contiguous with and is joined to the finger tip portion at a curved bottom 28 of the finger tip opening. The flattened portion desirably is offset to the side of the finger tip portion. With this construction and the specified opening width in the flattened portion, an elongated fingernail 26 on the finger tip 27 of a user can extend into the flattened portion of the tubular member, thus making the device conveniently usable by women with long fingernails.

It is desired that the present invention be fabricated simply and inexpensively. Nylon or other desirable moldable plastic can easily be fabricated to the shape shown. Tubular aluminum also could be used. In either case, it is necessary that at least one of the flat sides of the tab top opener be thin enough that it will easily fit under the tab of the tab top container in order to initiate the prying process. Desirably, the outer edges 22 of both sides of the flattened portion are tapered to a thin outer edge. This permits either side of the flattened portion to fit easily under the tab, so that the tab can be pried up with the hand to the side of the can (as shown) or with the hand in a reversed position over the can. In either case, with tapered outer edges, the inward portions of the flattened sides can be thicker in order to resist a stronger prying force.

It should be understood that the foregoing represents merely an exemplary embodiment of the present invention and that various modifications and changes may be made in the arrangements and details of construction of the embodiment disclosed herein without departing from the spirit and scope of the present invention, which is defined in the appended claims.

The embodiments of the present invention in which an exclusive property or privilege is claimed are defined as follows:

1. A finger tip operated tab top beverage container opener comprising a body having a finger tip opening in one end and a tab top opener at the other end, the finger tip opening being rounded and large enough to accommodate a finger tip, the tab top opener comprising a tab top prying member extending outwardly from the portion of the body housing the finger tip opening, the prying member having a pair of spaced sides that fit closely over and under the tab top such that the tab top can be opened by an upward rotational pressure exerted on the prying member by a finger tip inserted in the finger tip opening.

2. A finger tip operated tab top beverage container opener according to claim 1 wherein the body is a tubular member having open ends, with one end being rounded and serving as the finger tip opening and the other end having flattened sides and serving as the prying member of the tab top opener, at least one of said flattened sides having an outer edge that is thin enough to fit under the tab of a tab top beverage container.

3. A finger tip operated tab top beverage container opener comprising a body having a finger tip opening in one end and a prying member at the other end, the body comprising a tubular member having open ends, with one end being rounded and of sufficient size to serve as the finger top opening, the other end being a flattened portion having at least a pair of spaced flattened sides that fit closely over the tab top and serve as the prying member, at least one of said flattened sides having an outer edge that is thin enough to fit under the tab of a tab top beverage container, the tab top being opened by upward rotational pressure exerted on the prying member by a finger tip inserted in the finger top opening, the flattened portion of the opener being contiguous to and opening into the finger tip portion at a curved bottom of the finger tip portion, the flattened portion being offset to the side of the finger tip portion such that an elongated fingernail on the finger tip of the user can extend into the flattened portion of the opener.

4. A finger tip operated tab top beverage container opener according to claim 3 wherein the outer edges of both flattened sides are tapered to a thin outer edge so as to facilitate fitting either outer edge under the tab, the position of the opener being reversible to permit use of either flattened side under the tab so as to open the tab top with the hand facing upwardly or downwardly, the non-tapered portion of the tab being thick enough to withstand repeated openings of tab top containers.

5. A finger tip operated tab top beverage container opener according to claim 4 wherein the opener is formed of molded nylon.

* * * * *